US006057762A

United States Patent [19]

Dusza

[11] Patent Number: 6,057,762

[45] Date of Patent: May 2, 2000

[54] ALARM FOR PREVENTING LOSS OF A GOLF CLUB

[76] Inventor: David C. Dusza, 18690 Misty Lake Dr., Jupiter, Fla. 33458

[21] Appl. No.: 09/300,102

[22] Filed: Apr. 27, 1999

[51] Int. Cl.[7] ..... G08B 21/24

[52] U.S. Cl. ..... 340/568.6; 340/686.6; 340/693.9

[58] Field of Search ..... 340/568.6, 686.6, 340/693.9

[56] References Cited

U.S. PATENT DOCUMENTS

| | | | |
|---|---|---|---|
| 5,041,815 | 8/1991 | Newton | 340/568.6 |
| 5,126,719 | 6/1992 | DeSorbo | 340/571 |
| 5,493,274 | 2/1996 | Long | 340/568.6 |
| 5,635,897 | 6/1997 | Kuo | 340/311.1 |
| 5,781,109 | 7/1998 | Nakajima | 340/568.1 |
| 5,796,338 | 8/1998 | Mardirossian | 340/568.1 |
| 5,952,921 | 9/1999 | Donnelly | 340/568.6 |

*Primary Examiner*—Glen Swann
*Attorney, Agent, or Firm*—Kenneth L Tolar

[57] ABSTRACT

An alarm assembly for alerting a golfer whenever a golf club has been left behind includes a transponder unit attachable to the shaft of a golf club. The transponder unit is in selective communication with a remote unit attached to the golf bag or to the golfer. The remote unit is responsive to the transponder only within a predetermined range. The remote unit includes an audible and visual alarm, one of which is activated whenever the transponder is not within the predetermined range. The transponder unit is specifically configured such that it is only activated when attached to a golf club so as to not trigger false alarms when not in use.

10 Claims, 3 Drawing Sheets

ALARM FOR PREVENTING LOSS OF A GOLF CLUB

BACKGROUND OF THE INVENTION

The present invention relates to an alarm for preventing loss of a golf club, and more specifically, a device for alerting a golfer whenever a golf club is greater than a predetermined distance from the golfer or golf bag.

DESCRIPTION OF THE PRIOR ART

Golfers normally transport a golf bag having numerous golf clubs therein. The golfer either carries the bag on his or her shoulder or straps it to a golf cart. The golfer's ball often lands in remote locations such as in the woods, in a bunker or on the far side of the green. In such cases, it is more convenient to leave the bag behind and carry several clubs until the golfer determines the exact location of the ball. Once the proper club is selected, however, the other clubs are laid on the ground and, therefore, are often inadvertently left behind. The golfer may not realize that the particular club is missing until much later. Accordingly, the golfer must backtrack a significant distance to retrieve the club which interrupts the game tremendously. In some cases, the stranded club may have already been retrieved by another golfer and the golfer is unable to use the stranded club for the remainder of the round. The present invention relates to a unique alarm assembly for preventing golfers from inadvertently stranding their golf clubs on a golf course.

Various golf club alarm assemblies exist in the prior art. However, such devices are designed to prevent theft of a golf bag and are in no way designed to prevent golfers from inadvertently leaving clubs on the golf course. For example, U.S. Pat. No. 5,796,338 issued to Mardirossian discloses a system for preventing loss of a cellular phone or the like.

U.S. Pat. No. 5,781,109 issued to Nakajima discloses an alarm system for preventing loss of personal property.

U.S. Pat. No. 5,635,897 issued to Kuo discloses a mobile phone alarm.

U.S. Pat. No. 5,493,274 issued to Long discloses a golf bag alarm.

U.S. Pat. No. 5,126,719 issued to DeSorbo discloses a remotely armed alarm system.

U.S. Pat. No. 5,041,815 issued to Newton discloses a golf bag security alarm system including weight and motion sensitive devices attached to a golf bag.

Although various alarms for golf bags and clubs exist in the prior art, none relate to a device for alerting a user whenever a golf club has been inadvertently left behind.

SUMMARY OF THE INVENTION

The present invention relates to an alarm assembly for alerting a user that a club has been left behind. The device comprises a clip attachable to the shaft of each golf club. A transponder unit is removably attachable to each clip and is activated only when attached thereto. Each transponder unit is in selective communication with an integrated circuit disposed within a remote unit which is secured to the user or to the golf bag. Whenever the transponder is not within sufficient range to transmit and receive signals from the remote unit, an alarm on the remote unit is activated alerting a user that the club has been left behind. It is therefore an object of the present invention to provide an alarm for alerting a golfer whenever a club has been inadvertently left behind.

It is another object of the present invention to provide a device which may be conveniently attached to a plurality of golf clubs to signal a user if any of the golf clubs are misplaced.

It is yet another object of the present invention to provide a device that prevents a golfer from losing a club. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
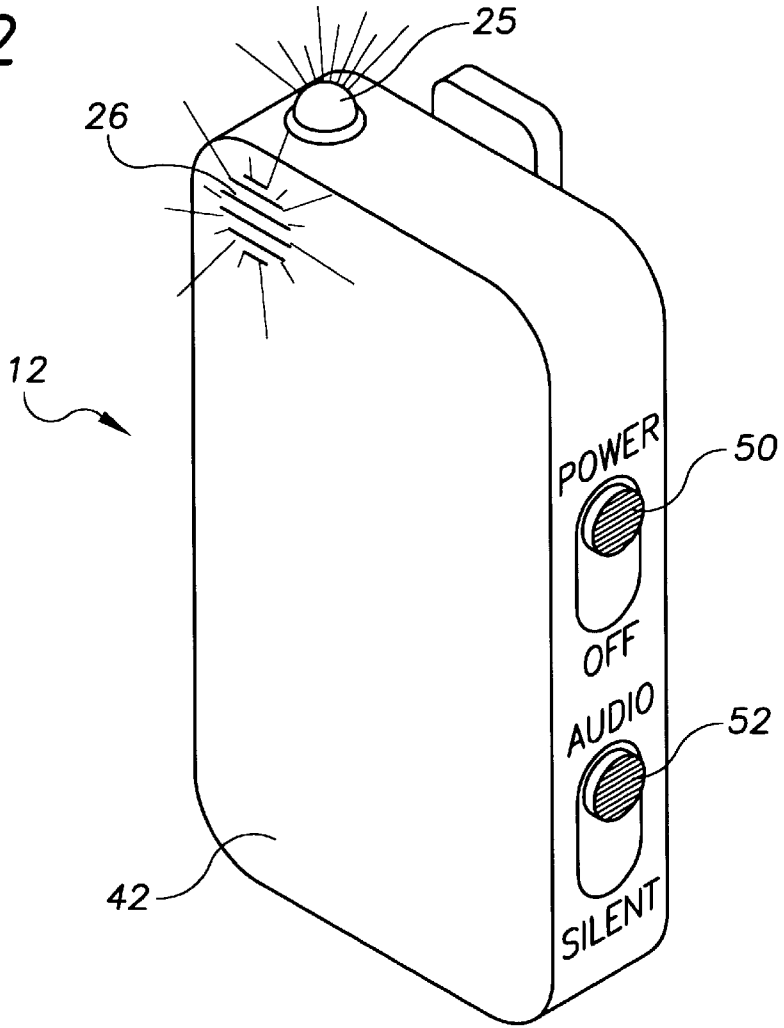
FIG. 2 depicts the remote unit.
Figure 1:
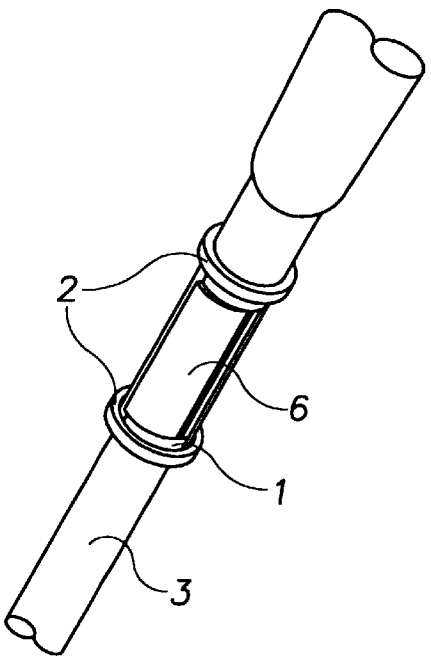
FIG. 1 depicts the clip and transponder unit attached to a golf club.
Figure 4:
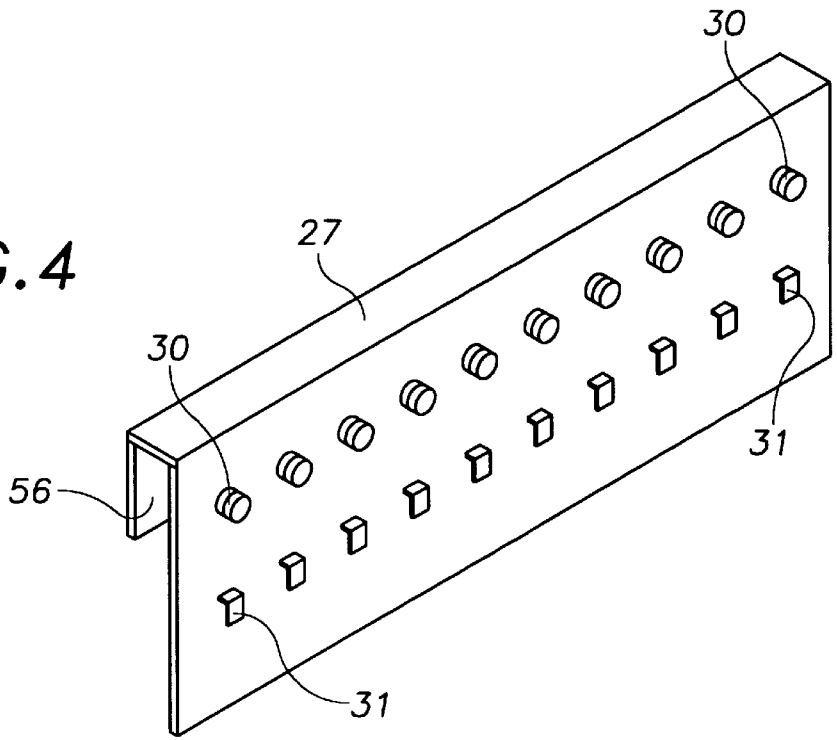
FIG. 4 depicts an accessory panel for removably storing a plurality of transponders.
Figure 3:
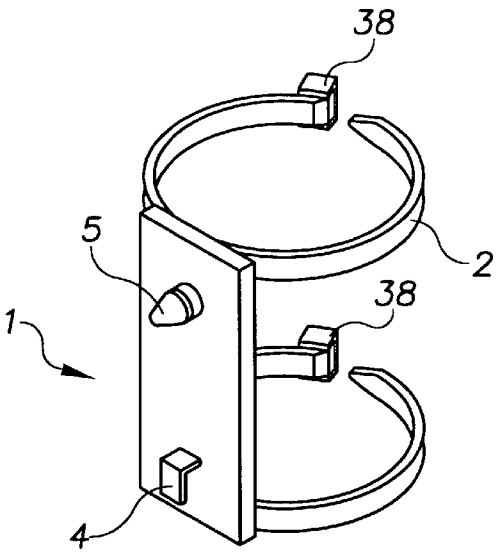
FIG. 3 is a close-up perspective view of the clip.
Figure 6:
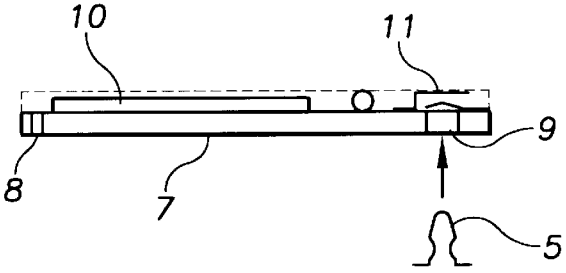
FIG. 6 is a side view of the transponder unit.
Figure 5:
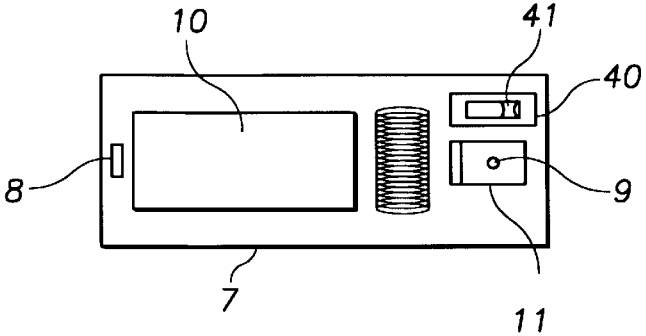
FIG. 5 is a bottom view of a transponder unit depicting the internal components.
Figure 7:
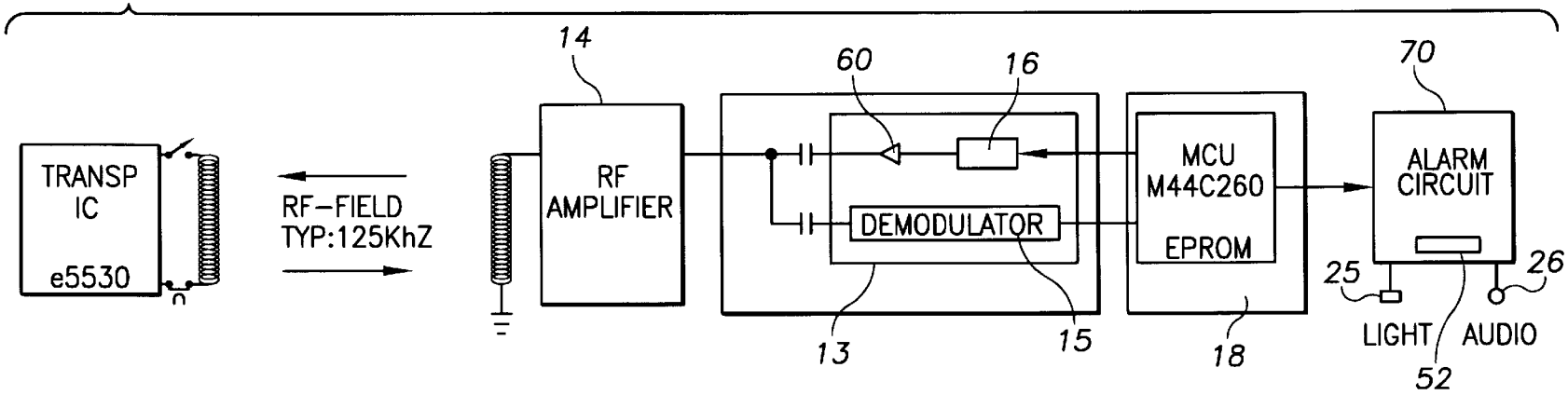
FIG. 7 is a schematic of the transponder and remote circuitry.

Referring now to FIGS. 1 and 7, the present invention relates to an alarm assembly for alerting a user whenever a golf club is left behind. The assembly comprises a clip member 1 having a pair of separable straps 2 secured thereto for attaching the clip member to a golf club shaft 3. The straps include mating fastener means such as buckles 38 or hook and loop fasteners. Alternatively, each clip member may be attached to a golf club shaft with adhesive or hook and loop fasteners on an inwardly facing side. Each clip member has an outwardly facing side with a latch member 4 and a tang 5 thereon.

The alarm assembly also includes a transponder unit 6 including a housing 7 having a slot 8 and an aperture 9 thereon, each positioned and configured to receive the latch member and tang respectively. Accordingly, the transponder unit housing may be quickly attached to the clip member. Received within the interior of the transponder unit housing is a conventional transponder 10 that is activated with a switch 11. The switch is positioned so as to be engaged by the tang when the tang is inserted into the aperture on the transponder unit housing. Accordingly, the transponder is inactive unless the housing is attached to the clip thereby preventing unattached transponder units from triggering a false alarm. The transponder unit may also include a second switch 40 for deactivating the transponder when the unit is attached to a clip. Therefore, a user can deactivate the alarm system without removing each of the individual transponder units. The switch 40 includes a brightly colored portion 41 to visually indicate whether the transponder is active.

The device also includes a remote unit 12 which is attachable to a user's golf bag, belt or similar location. The remote unit includes an outer case 42 having an integrated circuit 13 that, in conjunction with an EPROM 18, transmits and receives signals from the transponder. The integrated circuit 13 includes a demodulator 15, a buffer 60 and an oscillator 16. The circuit 13 is conventional such as a U2270B I.C. manufactured by Telefunken™. The signal generated by the circuit 13 is transmitted to an amplifier 14 that extends the range within which the signal will travel.

The amplifier increases the range within which the alarm will remain inactive so as to avoid triggering the alarm when a golf club is still nearby. The range may be further increased by adding a single transistor amplifier to the transponder unit. Whenever the transponder is not within receiving range of the remote unit, the transponder will cease transmitting a signal to the integrated circuit 13 at which time the EPROM transmits a signal to an alarm circuit 70. The alarm circuit includes a light means 25 and an audible alarm means 26 on the remote housing for either audibly or visually notifying a user that the transponder is out of range of the remote unit. The remote also includes a switch means 50 for selectively activating the remote unit and a mode switch 52 for interchangeably activating either the audible alarm or light means.

The assembly also includes a storage panel 27 for storing multiple transponder units when not in use. The panel includes a row of tangs 30 each having a flat distal end and a row of latches 31 similar to those on the clips. The length and configuration of the tangs assure that the transponder switch is not activated whenever a transponder unit is secured to the panel. The panel also includes an attachment clip 56 for securing the panel to a supporting device.

To use the above described device, a clip is attached to the shaft of each of the user's golf clubs. When playing a round of golf, the golfer attaches a transponder unit to each of the clips, placing the transponder in an active mode. If any of the transponders are out of the operating range, such as when the club is left behind, an alarm on the remote unit will be emitted.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An alarm for preventing loss of a golf club comprising:

a local receiver/transmitter means attachable to a golf club;

a remote reception/transmission means in two way communication with said local transmitter/receiver means when said local transmitter/receiver means is within a predetermined range of said remote reception/transmission means;

an alarm means in communication with said remote reception/transmission means for emitting an alarm whenever said local transmitter/receiver means is not within said predetermined range of said remote reception/transmission means.

2. An alarm according to claim 1 wherein said local transmitter/receiver means comprises a transponder.

3. An alarm according to claim 1 wherein said local transmitter/receiver means comprises:

a clip attachable to a golf club shaft;

a housing having a transponder received therein, said housing adapted to be removably attachable to said clip;

said housing further including a switch means in communication with said transponder that is activated only when said housing is attached to said clip.

4. An alarm according to claim 1 wherein said remote reception/transmission means includes a housing having an integrated circuit received therein for transmitting a signal to and receiving a signal from said local receiver/transmitter means;

said integrated circuit in communication with said alarm means, said alarm means activated whenever said integrated circuit is no longer receiving a signal from said local transmitter/receiver means.

5. An alarm according to claim 3 further comprising a panel adapted to retain a plurality of transponder housings thereon when said transponder housings are not in use.

6. An alarm according to claim 1 wherein said alarm means is a visual alarm.

7. An alarm according to claim 1 wherein said alarm means is an audible alarm.

8. An alarm according to claim 3 wherein said transponder housing includes a second switch means disposed thereon for deactivating said transponder.

9. An alarm according to claim 4 further comprising an amplifier means in communication with said integrated circuit for amplifying the signal transmitted by said integrated circuit.

10. An alarm for preventing loss of a golf club comprising:

a clip member attachable to a golf club shaft;

a housing adapted to be removably coupled to said clip member, said housing having a transponder received therein that is activated upon said housing and said clip member being coupled;

a remote unit including an integrated circuit in two way communication with said transponder for transmitting a signal to and receiving a signal from said transponder;

an alarm means in communication with said receiver means that is activated whenever said receiver means is not receiving a signal from said transponder.

* * * * *